US006749545B2

(12) United States Patent
Wu

(10) Patent No.: US 6,749,545 B2
(45) Date of Patent: Jun. 15, 2004

(54) FORCE-RETARDING DEVICE FOR A STATIONARY BICYCLE

(75) Inventor: Mu-Chuan Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 279 days.

(21) Appl. No.: 10/120,371

(22) Filed: Apr. 12, 2002

(65) Prior Publication Data

US 2003/0195090 A1 Oct. 16, 2003

(51) Int. Cl.[7] ..... A63B 69/16
(52) U.S. Cl. ..... 482/63
(58) Field of Search ..... 482/63; 74/574; 464/51; 280/217; 416/60

(56) References Cited

U.S. PATENT DOCUMENTS 4,786,050 A * 11/1988 Geschwender ..... 482/57
4,809,970 A * 3/1989 Beistegui ..... 482/64
5,094,447 A * 3/1992 Wang ..... 482/63
5,711,404 A * 1/1998 Lee ..... 188/164
6,641,507 B1 * 11/2003 Warner et al. ..... 482/63

* cited by examiner

*Primary Examiner*—Nicholas D. Lucchesi
*Assistant Examiner*—Tam Nguyen
(74) *Attorney, Agent, or Firm*—Bacon & Thomas, PLLC

(57) ABSTRACT

A force-retarding device for a stationary bicycle includes a supporting base, a flywheel provided on the supporting base, a transmitting element, a shaft combined with the flywheel and the transmitting element, and a movement-stopping base provided between the transmitting element and the shaft. The movement-stopping base has an annular vertical contact surface. At one side of the contact surface are orderly provided a first bearing, a separating ring and a second bearing. An annular sealer is provided, screwed on an inner annular surface of the transmitting element and located outside of the second bearing. Then the sealer may press against the first bearing, the separating ring, the second bearing and the movement-stopping base to leave no gap between them to prohibit the bearings from sliding right or left. So the force-retarding device may not give rise to vibration or noise in pedaling the stationary bicycle.

2 Claims, 3 Drawing Sheets

FORCE-RETARDING DEVICE FOR A STATIONARY BICYCLE

BACKGROUND OF THE INVENTION

This invention relates to a force-retarding device for a stationary bicycle, particularly to one improved to produce almost no vibration or noise in pedaling a stationary bicycle, and subsequently to prolong service life of the stationary bicycle.

A conventional force-retarding device for a stationary bicycle is shown in FIG. 1, containing a supporting base 10, a flywheel 20 mounted on the supporting base 10, a transmitting element 30 (such as a multi-grooved belt wheel) fixed with one side of the flywheel 20, and a shaft 40 with which are pivotally combined the flywheel 20 and the transmitting element 30 at the same time. Further, a plurality of permanent magnets 201 are equidistantly fixed on the inner annular surface of the flywheel 20, facing a silicon sheet stator 202 wound with coils immovably fixed with the supporting base 10. So when the flywheel 20 is rotated together with the transmitting element 30, the permanent magnets 201 rotate against the stator 202, with induction force produced between the magnets 201 and the stator 202. And the speed alteration of the flywheel 20 in rotation controls the volume of electric current and further controls the torque of the transmitting element 30. Then the torque forms the force-retarding action against pedaling of the stationary bicycle, obtaining effect of health improving exercise by pedaling.

However, the conventional force-retarding device for a stationary bicycle has been found to often give rise to vibration and noise in pedaling the stationary bicycle. After deep research, the cause of the problem has been found the way of positioning of the flywheel 20, which needs two bearings 50 deposited between the transmitting element 30 and the shaft 40 to enable the flywheel 20 together with the transmitting element 30 to rotate on the shaft 40 smoothly. As shown in FIG. 1, to position the bearings 50, C-shaped retain rings 50 are used to secure the outer surface of the bearings 50. Nevertheless, the C-shaped rings 50 may often have error in its thickness, say 0.1–0.2 mm, so that a 0.1–0.2 mm gap may be formed after the C-shaped retain rings 501 are fixed with the bearings 50. Then the result is that the bearings 50 may slide right and left, colliding with and rubbing the C-shaped retain rings 50 or other components when the flywheel 20 together with the transmitting element 30 rotates. Therefore, vibration and noise may arise in pedaling the stationary bicycle, with the colliding condition just mentioned above possibly breaking the C-shaped retain rings 50 in case of light colliding, or with the life of the bearings 50 shortened in case of serious colliding. In addition, there is another problem of insufficient loading force of the shaft 40 having only 15 mm diameter.

SUMMARY OF THE INVENTION

The purpose of the invention is to offer a force-retarding device for a stationary bicycle, which produces very little vibration or noise in pedaling it so as to prolong its service life.

The feature of the invention is a movement-stopping base provided between a flywheel and a transmitting element, both of which are pivotally combined on a shaft, and the movement-stopping base has an annular contact surface on which a first bearing, a separating ring and a second bearing are orderly mounted. Outside The second bearing an annular sealer is screwed on an inner surface of the transmitting element, pressing the second bearing, the separating ring and the first bearing toward the movement-stopping base so that there remains almost no gap between any of these components, and consequently no vibration or noise may be produced by the force-retarding device in pedaling the stationary bicycle.

BRIEF DESCRIPTION OF DRAWINGS

The invention will be better understood by referring to the accompanying drawings, wherein.

DETAILED DESCRIPTION OF THE PREFERRED EMBODIMENT

Figure 1:
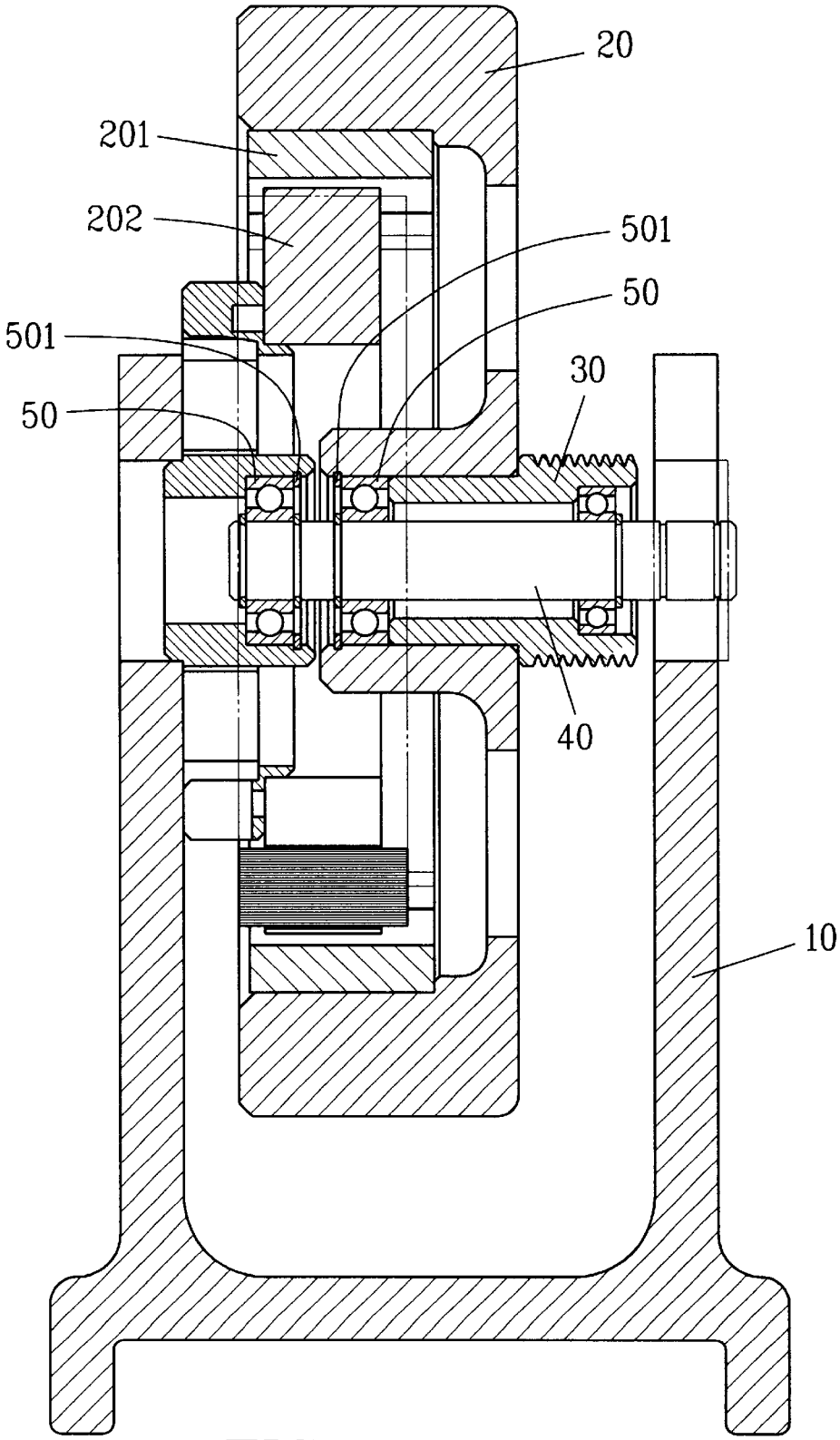
FIG. 1 (PRIOR ART)
FIG. 1 is a cross-sectional view of a conventional force-retarding device for a stationary bicycle.
Figure 2:
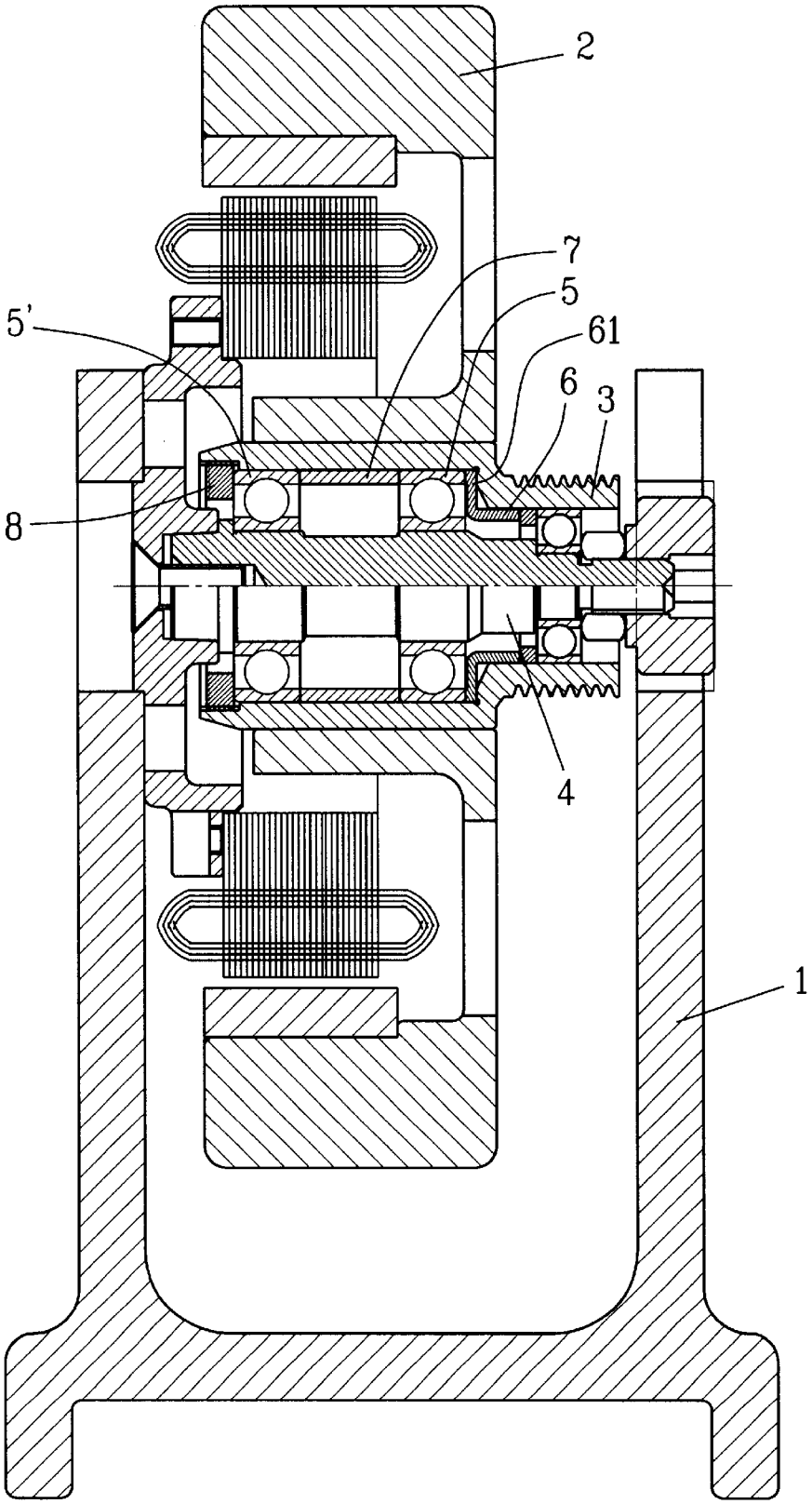
FIG. 2 is a cross-sectional view of a force-retarding device for a stationary bicycle in the present invention.

A preferred embodiment of a force-retarding device for a stationary bicycle in the present invention, as shown in FIG. 2, includes a supporting base 1, a flywheel 2 mounted on the supporting base 1, a transmitting element 3 (such as a multi-grooved belt wheel) fixed on an inner annular surface of the flywheel 2, and a shaft 4 on which the flywheel 2 and the transmitting element 3 are pivotally combined, as main components combined together.

Figure 3:
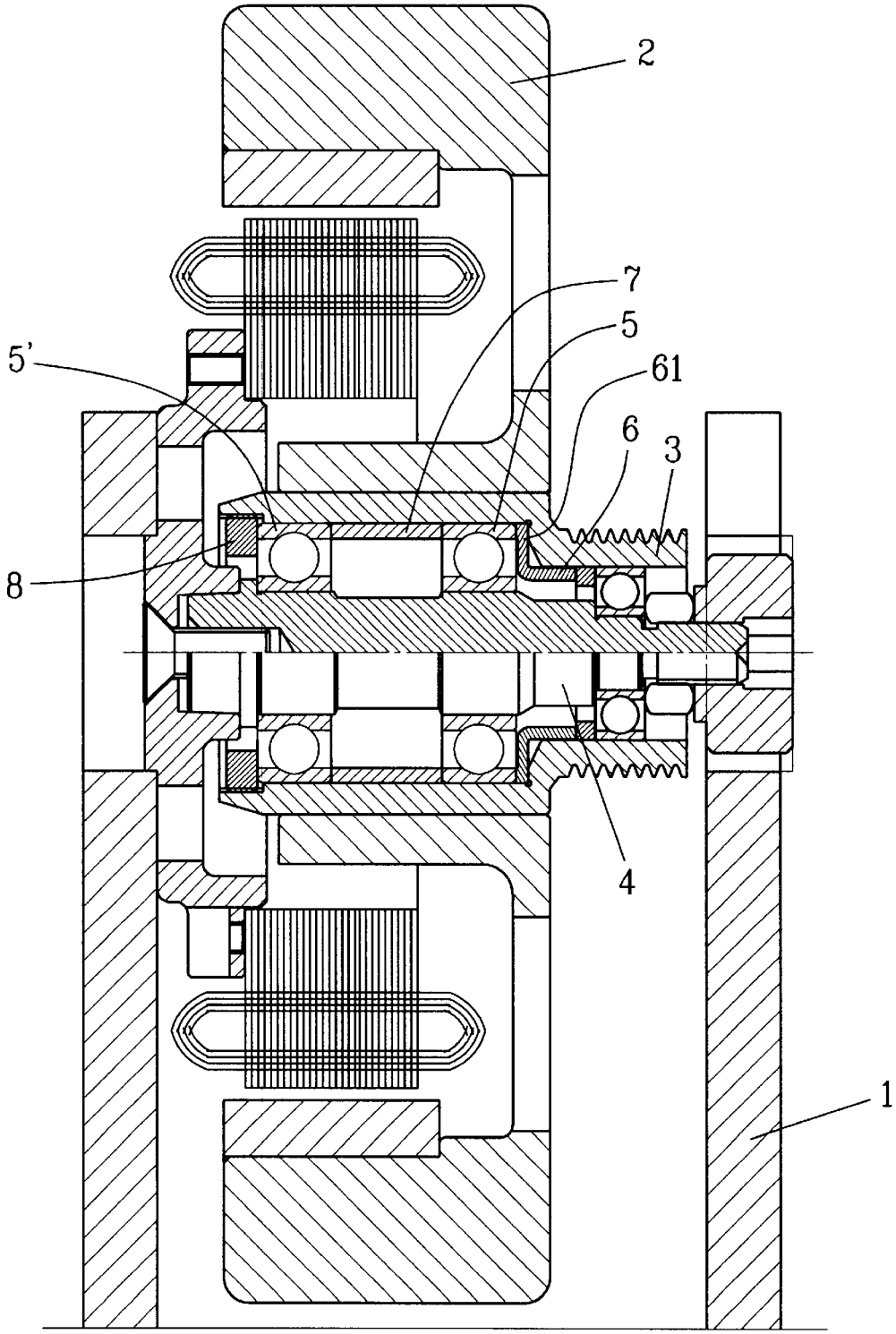
FIG. 3 is a partial magnified cross-sectional view of FIG. 2.

The shaft 4 is rotatably combined on the supporting base 1, having a diameter 17–25 mm, located through the transmitting element 3. A movement-stopping base 6 is provided between the transmitting element 3 and the shaft 4, as shown in FIG. 3, having an annular vertical contact surface 61. Then a first bearing 5, a separating ring 7 and a second bearing 5' are provided orderly on one side of the annular vertical contact surface 61, and all of the three components have a diameter as that of the inner annular diameter of the transmitting element 3. The second bearing 5' has its outer annular surface screwed with the inner annular surface of the transmitting element 3 and directly pressing against an annular sealer 8 provided outside of the second bearing 5.

After the force-retarding device is assembled together as described above, the sealer 8 directly presses against the outer surface of the second bearing 5' as it is screwed on the inner annular surface of the transmitting element 3. In other words, an axial pushing force is added to the second bearing 5', forcing the second bearing 5' to lean against the separating ring 7, which then presses toward the first bearing 5 and then the movement-stopping base 6. Consequently, the sealer 8, the second bearing 5', the separating ring 7, the first bearing 5 and the movement-stopping base 6 closely contact one another, leaving no gap between them. Therefore, when the transmitting element 3 rotates the flywheel 2, the first and the second bearing 5 and 5' can not slide right or left owing to no gap, impossible to give rise to any vibration or noise caused by collision of the two bearings against other components, as the conventional force-retarding device for a stationary bicycle does. Further, the shaft 4 can have a larger diameter than that of the conventional one, enhancing loading force. Thus, the service life of the stationary bicycle may be prolonged accordingly.

The preferred embodiment of the invention has been described above, and it will be recognized and understood that various modifications may be made therein and the appended claims are intended to cover all such modifications that may fall within the spirit and scope of the invention.

I claim:

1. A force-retarding device for a stationary bicycle comprising a supporting base, a flywheel mounted on said supporting base, a transmitting element having an outer annular surface fixed with said flywheel, a shaft on which said flywheel and said transmitting element are pivotally combined, and two bearings provided between said transmitting element and said shaft, and characterized by a movement-stopping base provided between said transmitting element and said shaft, said movement-stopping base having an annular vertical contact surface, on one side of said annuolar vertical contact surface provided orderly a first bearing, a separating ring and a second bearing, an annular sealer further provided screwed on an inner annular surface of said transmitting element and located outside said second bearing, said annular sealer pressing against said second bearing, said separating ring, said first bearing and said movement-stopping base so that said sealer, said second bearing, said separating ring said first bearing and said movement-stopping base may contact closely one another to leave no gap for said two bearings to slide right or left so that said force-retarding device is impossible to give rise to vibration or noise in pedaling the stationary bicycle, consequently prolonging service life of the stationary bicycle.

2. The force-retarding device for a stationary bicycle as claimed in claim 1, wherein said shaft has a diameter of 17–25 mm.

* * * * *